US009694596B2

(12) United States Patent
Morino et al.

(10) Patent No.: US 9,694,596 B2
(45) **Date of Patent: *Jul. 4, 2017**

(54) IMAGE PROCESSING DEVICE, IMAGE FORMING APPARATUS, METHOD OF FORMING IMAGE FOR DECORATING OBJECT, AND NON-TRANSITORY RECORDING MEDIUM

(71) Applicants: Tetsu Morino, Kanagawa (JP); Atsushi Yanaka, Saitama (JP)

(72) Inventors: Tetsu Morino, Kanagawa (JP); Atsushi Yanaka, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/170,304

(22) Filed: Jun. 1, 2016

(65) Prior Publication Data

US 2016/0355007 A1 Dec. 8, 2016

(30) Foreign Application Priority Data

Jun. 3, 2015 (JP) ..... 2015-113405
Apr. 7, 2016 (JP) ..... 2016-077392
May 27, 2016 (JP) ..... 2016-106018

(51) Int. Cl.

| | |
|---|---|
| ***B41J 2/21*** | (2006.01) |
| ***B41M 5/00*** | (2006.01) |
| *B41J 2/045* | (2006.01) |
| *B41M 7/00* | (2006.01) |

(52) U.S. Cl.

CPC ..... *B41J 2/2114* (2013.01); *B41M 5/0005* (2013.01); *B41J 2/04586* (2013.01); *B41M 7/0027* (2013.01)

(58) Field of Classification Search

CPC .. B41J 2/04535; B41J 2/2114; B41J 2/04586; B41M 7/0027

See application file for complete search history.

(56) References Cited

U.S. PATENT DOCUMENTS 9,227,395 B2 * 1/2016 Hatanaka ..... B41J 2/04535
2013/0260107 A1 * 10/2013 Usuda ..... B41M 5/50 428/195.1
2015/0251412 A1 * 9/2015 Hatanaka ..... B41J 2/04535 347/14

FOREIGN PATENT DOCUMENTS

| | | |
|---|---|---|
| JP | 63-104816 | 5/1988 |
| JP | 2005-199625 | 7/2005 |
| JP | 2006-082463 | 3/2006 |

(Continued)

*Primary Examiner* — Manish S Shah
*Assistant Examiner* — Yaovi M Ameh
(74) *Attorney, Agent, or Firm* — Harness, Dickey6 & Pierce, PLC

(57) ABSTRACT

An image processing device includes circuitry to acquire image data of an image to be formed by a recording unit employing an inkjet method, calculate, based on the image data, ink thickness per pixel that indicates a thickness of ink to be discharged to form the image, set the maximum ink thickness per pixel of the entire image as a target thickness of the image, calculate, for each pixel, the difference between the target thickness and the ink thickness per pixel, create complementary data regulating thickness compensating the difference, and create print data including the image data and the complementary data.

15 Claims, 10 Drawing Sheets

(56) References Cited

FOREIGN PATENT DOCUMENTS

| | | |
|---|---|---|
| JP | 2012-106369 | 6/2012 |
| JP | 2013-146937 | 8/2013 |

* cited by examiner

IMAGE PROCESSING DEVICE, IMAGE FORMING APPARATUS, METHOD OF FORMING IMAGE FOR DECORATING OBJECT, AND NON-TRANSITORY RECORDING MEDIUM

CROSS-REFERENCE TO RELATED APPLICATIONS

This patent application is based on and claims priority pursuant to 35 U.S.C. §119(a) to Japanese Patent Application Nos. 2015-113405, 2016-077392, and 2016-106018, filed on Jun. 3, 2015, Apr. 7, 2016, and May 27, 2016, respectively, in the Japan Patent Office, the entire disclosures of which are hereby incorporated by reference herein.

BACKGROUND

Field of the Invention

The present invention relates to an image processing device, an image forming apparatus, a method of forming an image for decorating an object, and a non-transitory recording medium.

Description of the Related Art

A technology of decorating a solid object is known which includes forming an image on an extensible film with ink extensible after printing and attaching or transferring the film to a solid image while drawing the film along the solid object.

The color composition is calculated in the technology according to the extension ratio. However, since the density of a single ink layer is limited by a ceiling, the density at a site having a large extension ratio does not reach a desired level.

SUMMARY OF THE INVENTION

According to the present disclosure, provided is an improved image processing device includes circuitry to acquire image data of an image to be formed by a recording unit employing an inkjet method, calculate, based on the image data, ink thickness per pixel that indicates a thickness of ink to be discharged to form the image, set the maximum ink thickness per pixel of the entire image as a target thickness of the image, calculate, for each pixel, the difference between the target thickness and the ink thickness per pixel, create complementary data regulating thickness compensating the difference, and create print data including the image data and the complementary data.

BRIEF DESCRIPTION OF THE SEVERAL VIEWS OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein like reference characters designate like corresponding parts throughout and wherein.

Figure 1:
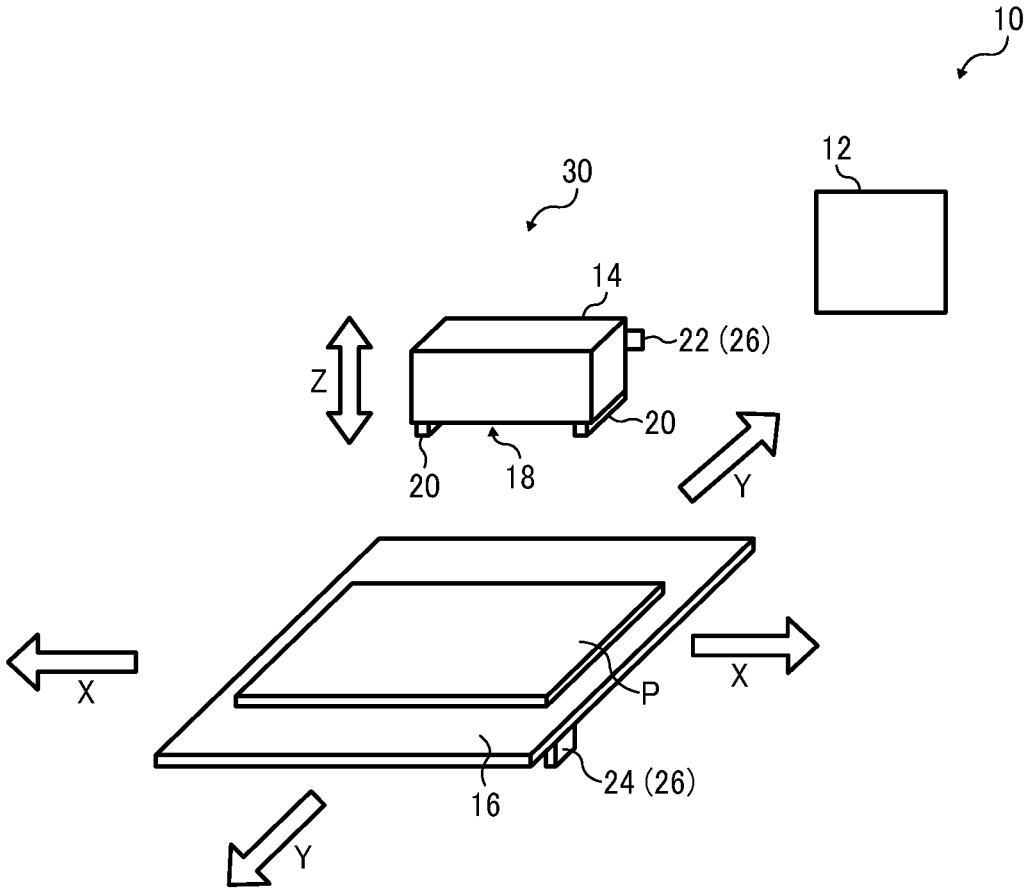
FIG. 1 is a schematic diagram illustrating an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

The present disclosure is described in detail with reference to embodiments. The present disclosure is about image forming with ink having a large extension ratio and extensible after printing.

That is, ink extensible after printing is preliminarily laminated on a site where the ink density is insufficient to increase the density in comparison with a case of a single ink layer.

The present disclosure is described with reference to the accompanying drawings.

The present disclosure is described with reference to embodiments. The present disclosure is about image forming with ink having a large extension ratio and extensible after printing.

That is, ink extensible after printing is preliminarily laminated on a site where the ink density is insufficient to increase the density in comparison with a case of a single ink layer.

The present disclosure is described with reference to the accompanying drawings.

Image Forming Apparatus

Configuration

Embodiments of the image forming apparatus are described in detail.

FIG. 1 is a diagram illustrating an example of an image forming apparatus 10.

Figure 2:
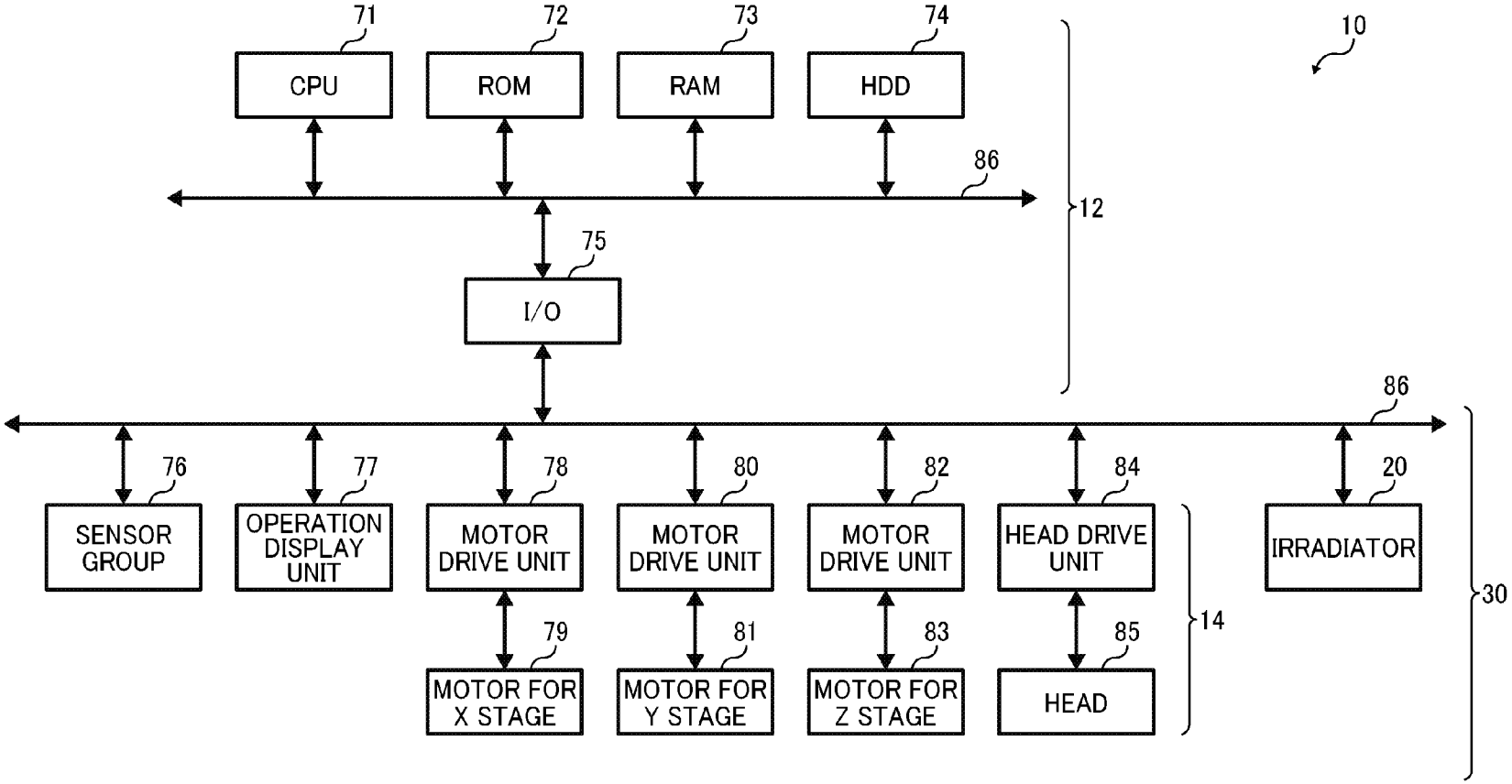
FIG. 2 is a block diagram illustrating an example of the hardware of the image forming apparatus illustrated in FIG. 1.

The image forming apparatus 10 includes an image processing device 12 and a recording device 30. The image processing device 12 and the recording device 30 are communicatively connected to each other, via an input/output 75 (FIG. 2).

The recording device 30 includes a recording unit 14, an operation stage 16, and a drive unit 26. The recording unit 14 includes multiple nozzles. The recording unit 14 is an inkjet recording unit including multiple nozzles and discharges liquid droplets from each of the nozzles to record dots. The nozzle is disposed on the surface of the recording unit 14 facing the operation stage 16.

In this embodiment, the liquid droplet includes at least one of an ink droplet and an additional droplet. The ink droplet contains a coloring material for use in image forming. That is, in this embodiment, the image is formed with ink. In addition, the ink described below is extensible post-printing.

The additional droplet has a color having no impact on an image at least in its appearance when viewed with the human eye. The additional droplet is, for example, white or transparent. Alternatively, the additional droplet may have a similar color to that of a substrate P of an image forming subject. The substrate P is an image forming subject of an image with ink droplets. The substrate P is, for example, a recording medium. In addition, the substrate P can be formed by discharging droplets utilizing an inkjet method.

The ink droplet and the additional droplet are curable on stimulus. The stimulus is, for example, light (ultraviolet, infrared, etc.), heat, electricity, etc. In this embodiment, a case in which the ink droplet and the additional droplet are ultraviolet curable is described. The ink droplet and the additional droplet are not limited to those ultraviolet curable.

An irradiator 20 is disposed on the recording unit 14, facing the operation stage 16. The irradiator 20 irradiates the substrate P with light having a wavelength that cures the ink droplets or the additional droplets discharged from the nozzle. In this embodiment, the irradiator 20 emits ultraviolet rays. In this example, two irradiators 20 are disposed, however, the irradiators 20 may be collectively referred to as the irradiator 20 for simplicity.

The operation stage 16 holds the support P. The drive unit 26 relatively moves the recording unit 14 and the operation stage 16 in the vertical direction (Z direction in FIG. 1), a main scanning direction X perpendicular to the vertical direction Z, and a sub-scanning direction Y perpendicular to the vertical direction Z and the main scanning direction X.

In this embodiment, the plane formed along the main scanning direction X and the sub-scanning direction Y corresponds to the XY plane in the operation stage 16 along the plane facing the recording unit 14.

The drive unit 26 includes a first drive unit 22 and a second drive unit 24. The first drive unit 22 moves the recording unit 14 in the vertical direction Z, the main scanning direction X, and the sub-scanning direction Y. The second drive unit 24 moves the operation stage 16 in the vertical direction Z, the main scanning direction X, and the sub-scanning direction Y. The image forming apparatus 30 may have a configuration having only one of the first drive unit 22 and the second drive unit 24.

FIG. 2 is a block diagram illustrating an example of the hardware of the image forming apparatus 10 illustrated in FIG. 1.

The image forming apparatus 10 illustrated in FIG. 2 includes an image processing device 12 and a recording device 30 as described above.

The image processing device 12 includes a central processing unit (CPU) 71, a read only memory (ROM) 72, a random access memory (RAM) 73, and optionally a hard disk drive (HDD) 74. The reference numeral 86 represents a bus line.

The recording device 30 includes a sensor group 76, an operation display 77, motor drivers 78, 80, and 82, a motor 79 for X stage, a motor 81 for Y stage, a motor 83 for Z stage, the recording unit 14 including a head driver 84 and a head 85. The reference numeral 87 represents a bus line. The image forming apparatus 10 further includes the irradiator 20.

The CPU 71 is a circuit to control entire operation of the image forming apparatus 10. The ROM 72 is a special read-out memory storing control programs and an example thereof is a mask ROM. The RAM 73 is a rewritable memory to temporarily store the control program stored in the ROM 72 and an example thereof is, for example, a flash memory. The HDD 74 is a rewritable memory to store a larger size of image data or document data than the control program.

The I/O 75 is a circuit connected to, for example, the image processing device 12 or a personal computer (PC) to send and receive control data, image data, etc. The sensor group 77 detects the position of each stage and the amount of a transfer film 40 and examples thereof are a linear positioning sensor, a micro switch, and an end-measuring machine. In addition, the sensor group 77 is, for example, LEDs and optical sensors set for each stage and encoders disposed facing the stage. Irradiation light from the LED is reflected at the encoder and the optical sensor receives reflected light to detect the position of the stage. The operation display unit 77 includes switches, buttons, keys, and a liquid crystal display for a user to operate the image forming apparatus 70. The motor drive units 78, 80, and 82 are circuits to drive the motors of the respective stages. The motor 79 for X stage drives the X stage of the operation stage 16 in the X direction. The motor 81 for Y stage drives the Y stage of the operation stage 16 in the Y direction. The motor 83 for Z stage drives the Z stage of the operation stage 16 in the Z direction.

Figure 3:
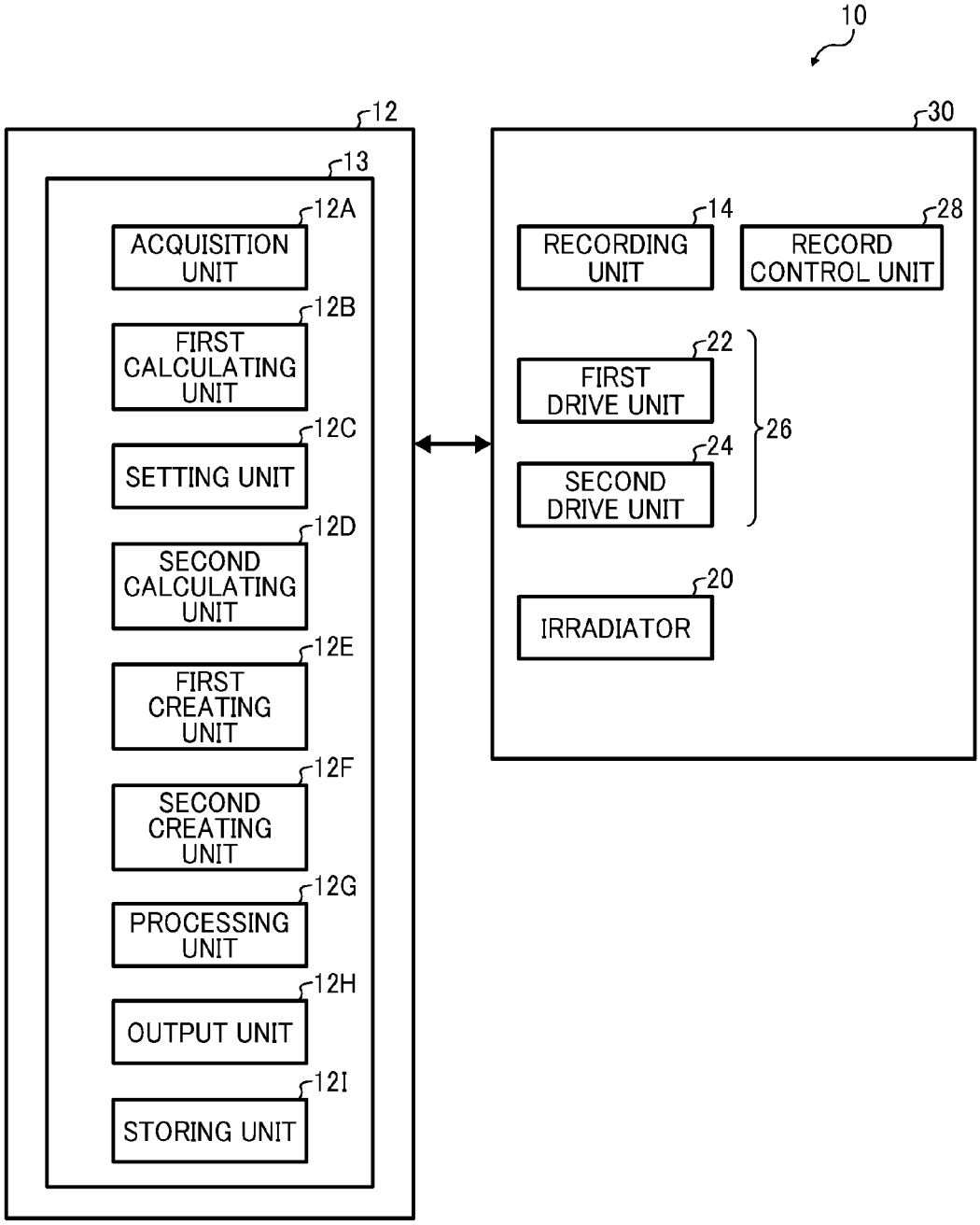
FIG. 3 is a diagram illustrating an example functional block diagram of a part of the image forming apparatus illustrated in FIG. 1.

FIG. 3 is a diagram illustrating an example of the block diagram of function of a controller illustrated in FIG. 2.

The recording device 30 includes the recording unit 14, a record control unit 28, the drive unit 26, and the irradiator 20.

The irradiator 20 is disposed on both ends of the head in the arrangement direction of each nozzle. The droplet discharged from each nozzle is cured upon application of UV light emitted from the irradiator 20. It is preferable to arrange the irradiator 20 around the nozzle.

The drive unit 26 drives the operation stage 16.

The record control unit 28 receives print data from the image processing device 12. The record control unit 28 controls the recording unit 14, the drive unit 26, and the irradiator 20 in order to discharge the droplet corresponding to each pixel from the nozzle in response to the received print data.

The image processing device 12 includes a main control unit 13. The main control unit 13 is a computer having a configuration including CPU 71, etc. and controls the entire of the image processing device 12. Alternatively, the main control unit 13 may be configured by a circuit such as an ASIC.

The main control unit 13 includes an acquire unit 12A, a first calculating unit 12B, a setting unit 12C, a second calculating unit 12D, a first creating unit 12E, a second creating unit 12F, a processing unit 12G, an output unit 12H, and a memory 12I.

For example, the processing device such as CPU executes programs of part or the entire of these acquire unit 12A, first calculating unit 12B, setting unit 12C, second calculating unit 12D, first creating unit 12E, second creating unit 12F, and output unit 12G. That is, these can be executed by software, hard ware such as an integrated circuit (IC), or a combination of software and hardware.

The acquisition unit 12A acquires image data. The image data are created for an image to be formed by the recording unit 14 of the recording device 30. In addition, as described above, the image is formed by ink droplets based on the image data. The acquisition unit 12A acquires image data from external devices via a communication unit or from the memory 12I provided to the image processing device 12.

The main control unit 13 illustrated in FIG. 3 is implemented by the CPU 71, the ROM 72, and the RAM 73. The recording device 30 illustrated in FIG. 3 is implemented by the head drive unit 84, the head 85, and the irradiator 20 illustrated in FIG. 2.

Transfer Film

Configuration

Figure 4:
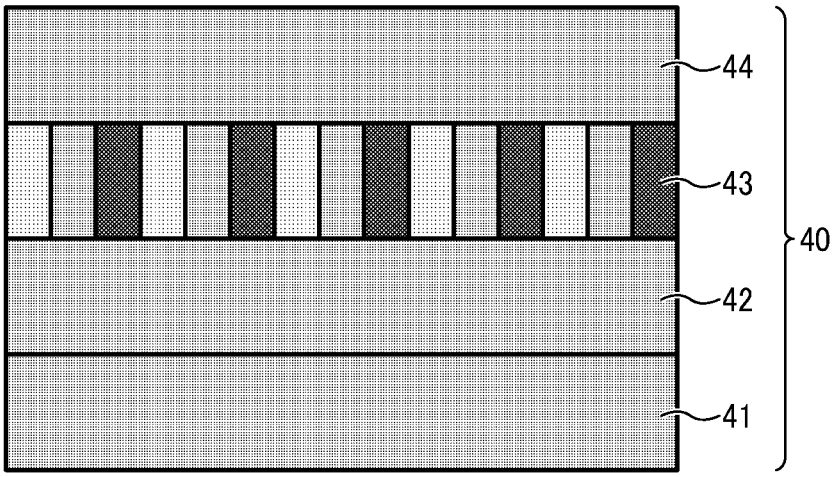
FIG. 4 BACKGROUND ART
FIG. 4 is a diagram illustrating an example of the formation of a transfer film for inkjet.

FIG. 4 is a diagram illustrating an example of the configuration of a transfer film for inkjet.

The transfer film 40 is also referred to as a decorative film and includes a substrate 44, an ultraviolet (UV) print layer 43, a primer layer, and a separate film 41, which are sequentially formed.

Ink extensible after printing is printed on the transfer film 40 and the transfer film 40 is drawn along a part 50 (FIG. 5) serving as a target of decoration.

To obtain the transfer film 40, an inkjet UV ink is printed on the substrate 44 having a film-like form to form the UV print layer 43. The UV print layer 43 is irradiated with UV light to cure the inkjet UV ink. The primer layer 42 to attach the transfer film 40 to the part 50 is applied to the UV print layer 43. Also, the separate film 41 is attached to the primer layer 42 to protect the primer layer 42 until the transfer film 40 is attached to part 50.

Operation

FIGS. 5A, 5B, 5C, and 5D are diagrams illustrating an example describing the method of decorating a part with a transfer film for inkjet.

An example of a method of decorating a part with a transfer film is described with reference to FIGS. 5A to 5D.

In FIGS. 5A to 5D, the reference numeral 60 represents a vacuum forming machine for vacuum pressurizing and heating. The machine includes a vessel, an infrared heater 61, a vacuum pressure pump 62, sluice valves 63 and 65, a vacuum pump 64, and the operation stage 16.

When vacuum-heating the top part of the transfer film 40 in the machine 60 and vacuuming the bottom part of the transfer film 40, the infrared heater 61 is turned on and the sluice valve 63 is full-open to activate the vacuum pressure pump 62 as a vacuum pump to full-open the sluice valve 65, thereby operating the vacuum pump 64.

When pressurizing and heating the top part of the transfer film 40 in the machine 60 and vacuuming the bottom part of the transfer film 40, the infrared heater 61 is turned on and the sluice valve 63 is full-open to activate the vacuum pressure pump 62 as a pressure pump to full-open the sluice valve 65, thereby operating the vacuum pump 64.

Figure 5A:
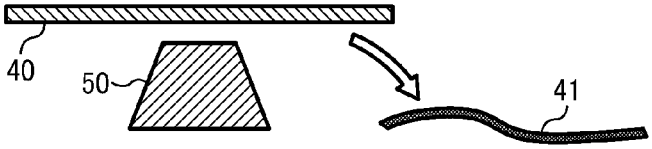
FIG. 5A BACKGROUND ART
FIGS. 5A, 5B, 5C, and 5D are diagrams illustrating an example describing the method of decorating a part with a transfer film for inkjet.

As illustrated in FIG. 5A, the separate film 41 is stripped off from the transfer film 40 illustrated in FIG. 4 and set in the vacuum forming machine 60.

Figure 5B:
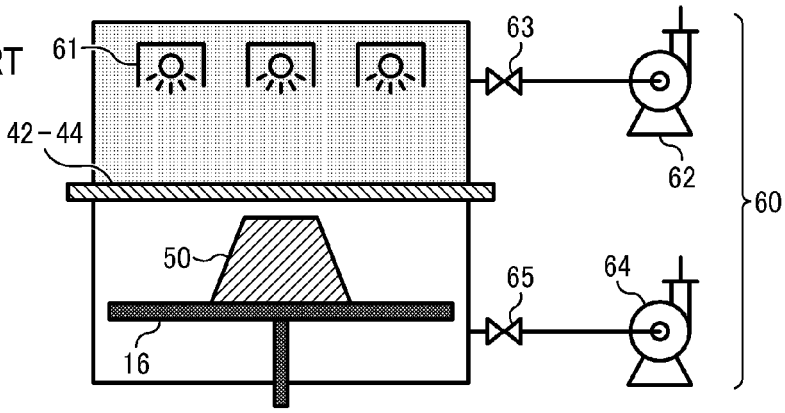
FIG. 5B BACKGROUND ART

As illustrated in FIG. 5B, each of the top and the bottom of the primer layer 42 to the substrate 44, which is the remaining without the separate film 41 of the transfer film 40, is subject to vacuuming by the vacuum pump. Thereafter, the primer layer 42 to the substrate 44 are heated by a heater from the top of the primer layer 42 to the substrate 44. The primer layer 42 to the substrate 44 are softened by this heating, so that those are easily drawn.

Figure 5C:
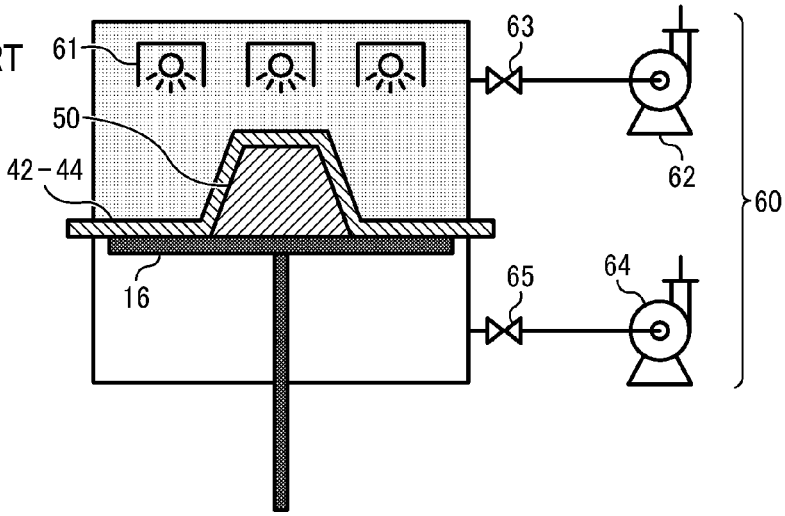
FIG. 5C BACKGROUND ART

As illustrated in FIG. 5C, when the primer layer 42 to the substrate 44 reach a regulated temperature, the stage 51 is elevated to lift the part 50 and thereafter the pressure is changed from vacuum to normal pressure pressurize the top thereof. In this operation, the pressure at the top of the film is increased in comparison with the bottom, so that the transfer film 40 is easily attached to the part 50. Therefore, the primer layer 42 to the substrate 44 are securely attached. In this attachment and transfer, the primer layer 42 to the substrate 44 are drawn tracing the form of the part 50.

Figure 5D:
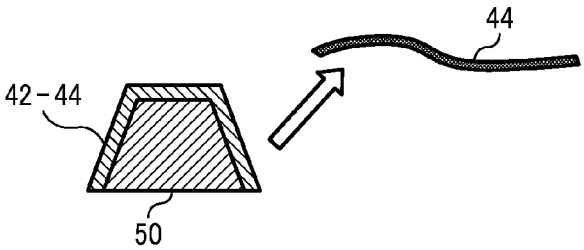
FIG. 5D BACKGROUND ART

As illustrated in FIG. 5D, the substrate 44 having a film-like form is stripped off to complete the decoration of the part 50.

Comparative Example

Figure 6:
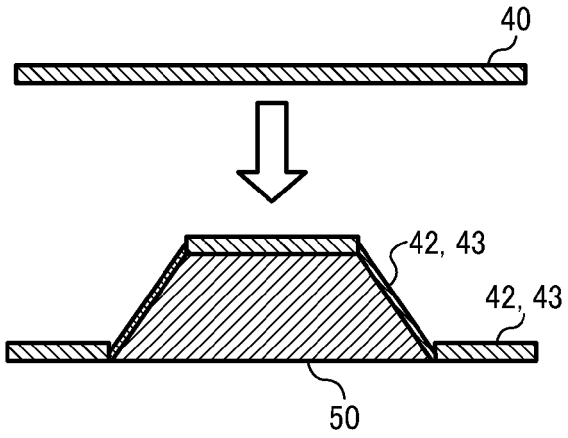
FIG. 6 BACKGROUND ART
FIG. 6 is a diagram illustrating a typical decoration.

FIG. 6 is a diagram illustrating a typical decoration.

With regard to drawing and forming the transfer film 40, the transfer film 40 is drawn tracing the form of the part 50 so that the transfer film 40 is closely attached and transferred to decorate the part 50. Therefore, at a site having a large elongation ratio, for example, an inclined plane of the form (trapezoid) of the part 50, the thickness of the UV print layer 43 relatively decreases. This decreases in the thickness of the UV print layer 43 may further cause the color of the ink at that portion to look relatively pale.

While density correction methods may be applied, such density correction methods have the following drawbacks.

Firstly, the density of ink is limited by a ceiling and it is impossible to increase the density beyond the limit. Secondly, the maximum droplet size dischargeable from the inkjet head once also has a limit.

In an attempt to dissolve such drawbacks, for example, resolution can be increased (for example, from 1,200 dpi to 2,400 dpi). However, such a high resolution as 2,400 dpi is an excessive performance for other imaging areas, meaning that the entire machine is manufactured based on such an unnecessarily high specification. Specifically, increase of the amount of required memory for image forming and increase of the power of encoder leads to cost increase of the device and demands high level of part accuracy.

Embodiment 1

Figure 7:
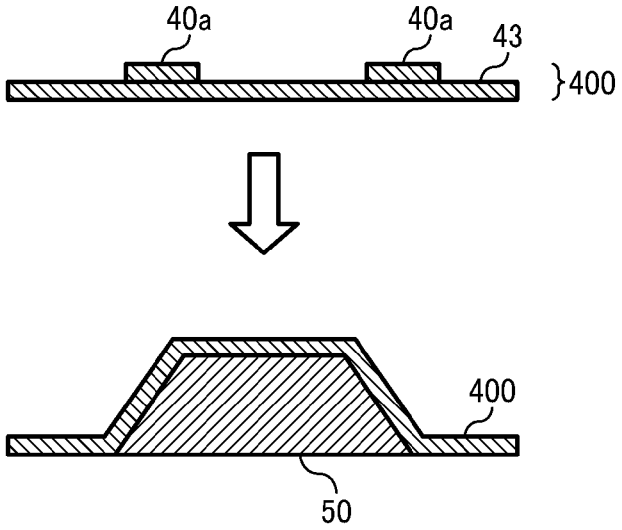
FIG. 7 is a diagram illustrating the formation according to an embodiment of the present disclosure.

FIG. 7 is a diagram illustrating the configuration according to an embodiment of the present disclosure. The primer layer 42 is omitted in FIG. 7.

To avoid the issues of the typical decoration, as illustrated in FIG. 7, after the first layer (UV print layer) 43 is printed on a site having a large elongation ratio and a less density as a result of drawing, a second layer 40*a* is printed on the first layer 43 in the present disclosure. Therefore, thus-obtained UV print layer 400 has an ink layer having a sufficient thickness at the site having a large extension ratio so that the ink density after drawing is secured. The number of layers to be laminated is not limited to two. Multiple layers such as three layers or four layers can be laminated.

The way of determining the necessity of lamination and the number of layers can be determined in many ways. For example, data of density change per ink layer according to the extension ratio depending on the way of discharging (for example, the size of droplet, large droplet, middle-size droplet, small droplet) for printing are preliminarily obtained. By making a selection based on a comparison of the data with the density required at a desired site and the extension ratio, the number of layers and the way of discharging droplets are selected. The density required at a desired site and the extension ratio can be obtained referring to, for example, Japanese Unexamined Patent Application Publication Nos. 2005-199625 and 2012-106369.

Figure 8A:
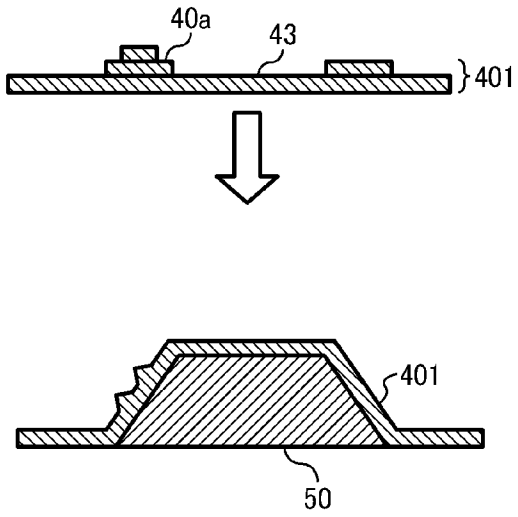
FIG. 8A BACKGROUND ART
FIGS. 8A and 8B are diagrams illustrating an example of typical multiple layer lamination and FIG. 8C is a diagram illustrating an example of multiple layer lamination according to an embodiment of the present disclosure.
Figure 8B:
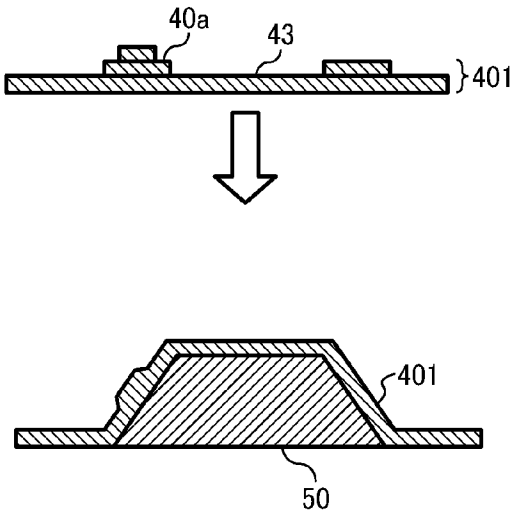
FIG. 8B BACKGROUND ART
Figure 8C:
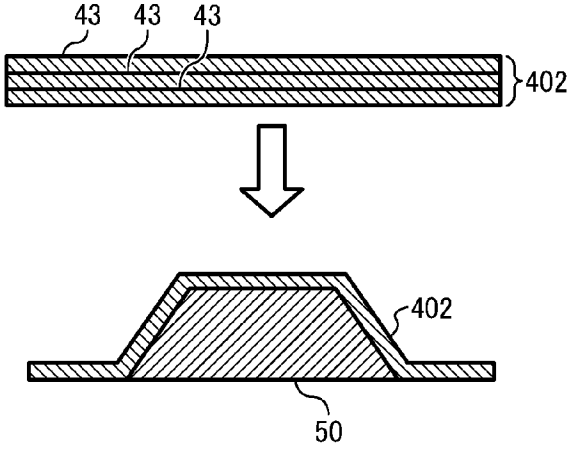

FIGS. 8A and 8B are diagrams illustrating an example of typical multiple layer lamination and FIG. 8C is a diagram illustrating an example of multiple layer lamination according to an embodiment of the present disclosure.

As illustrated in FIG. 7, if multiple layers are formed at a site having a high density to form a UV print layer 401, a desired density can be obtained. However, there is a slight difference of the drawing force at the boundary between the multiple-layer laminated site and other sites. Therefore, uneven portion may be formed on the boundary (FIG. 8A).

Similarly, all the part of the laminated UV print layer 401 may become uneven (FIG. 8B). These have little impact with regard to color but may particularly stand out on the gloss surface depending on light. In such a case, the part loses aesthetic appearance and such unevenness can be recognized by touch.

To solve these problem, as illustrated in FIG. 8C, all the top surface of the part 50 is covered with a UV print layer 402 having a three-layer structure to prevent unevenness of the surface after drawing and forming.

Figure 9:
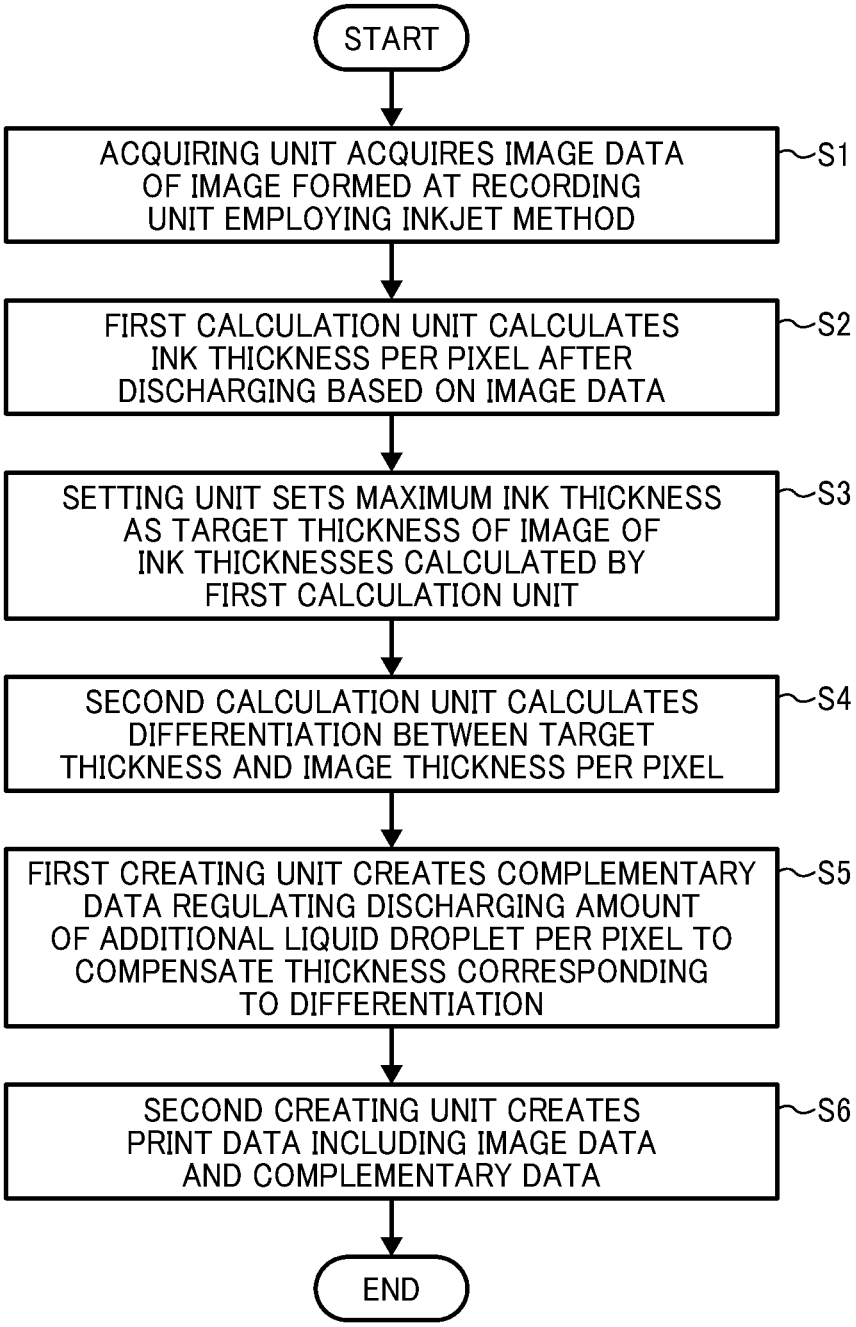
FIG. 9 is a flowchart illustrating an example of creating print data the image forming apparatus illustrated in FIG. 1 send to the recording device 30.
Figure 10:
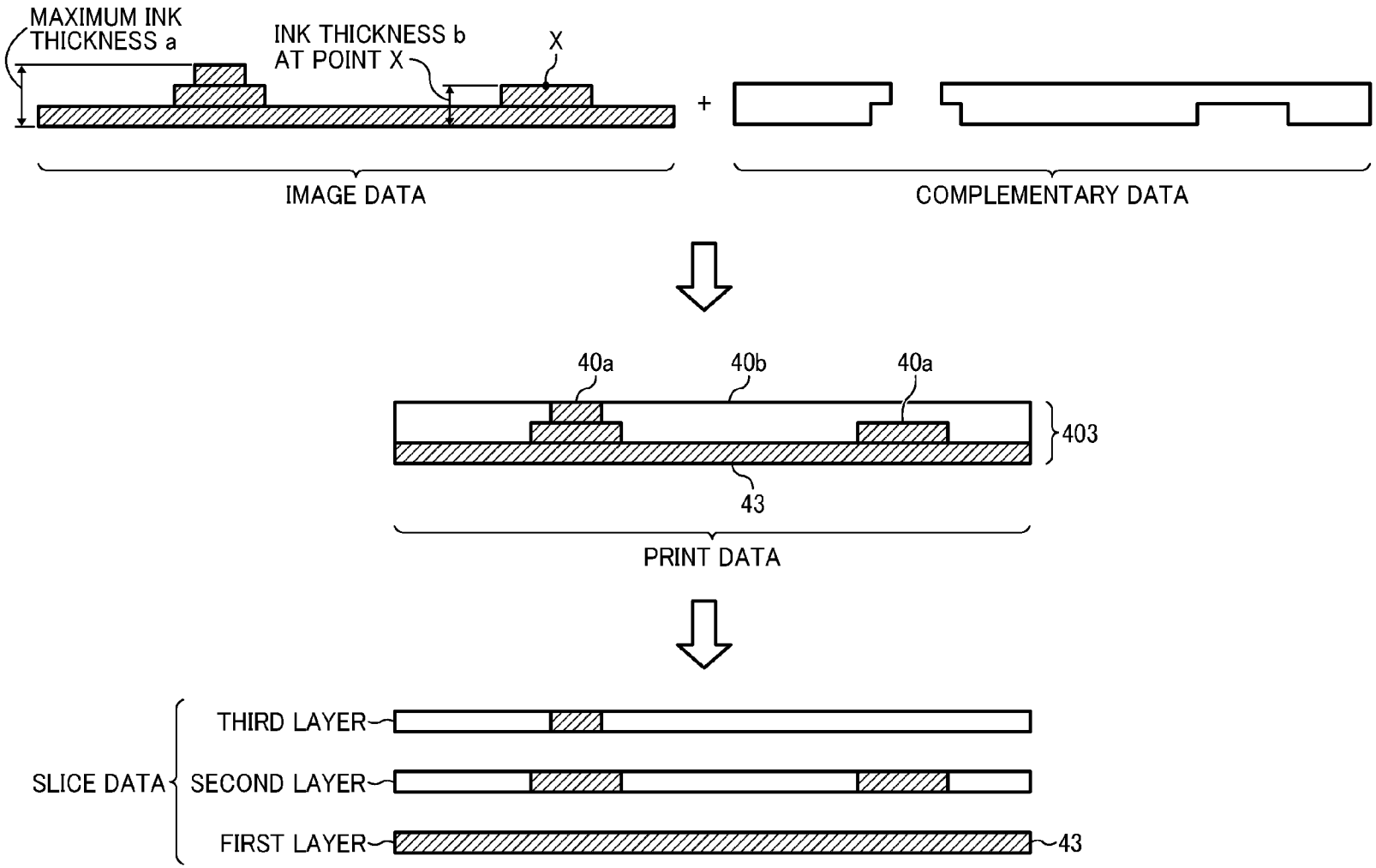
FIG. 10 is a diagram illustrating the processing method of image data.

FIG. 9 is a flowchart illustrating creating print data the image processing device sends to the recording device 30 and FIG. 10 is a diagram illustrating the processing method of image data.

The acquisition unit 12A acquires image data (S1). As described above, the acquisition unit 12A acquires image data from external devices via a communication unit or from the memory 12H provided to the image processing device 12. The communication unit may be any desired network interface connected to a network such as the Internet.

Next, the first calculating unit 12B calculates ink density per pixel based on the image data the acquisition unit 12A acquires. The method of the first calculating unit 12B calculating ink density per pixel is disclosed in Japanese Unexamined Patent Application Publication Nos. 2005-199625 and 2012-106369 as described above. The first calculating unit 12B calculates ink thickness per pixel based on the calculated ink density (S2).

Next, the setting unit 12C acquires the maximum thickness of the ink thicknesses of all the pixels. In the case of FIG. 10, the setting unit 12C set the maximum ink thickness a. The setting unit 12C sets the maximum ink thickness as the target value (S3).

Next, the second calculating unit 12D calculates the difference between the ink thickness set by the setting unit 12C and the ink thickness calculated by the first calculating unit 12B for each pixel. In the case illustrated in FIG. 10, when the ink thickness at point x is b, the second calculating unit 12D calculates the difference as a−b.

Next, the first creating unit 12E creates complementary data based on the difference in the ink thicknesses for all the pixel the second calculating unit 12D calculates. The second creating unit 12F unifies the image data and the complementary data to create print data.

The processing unit 12G divides the print data in the height direction to obtain slice data (first layer data, second layer data, and third layer data) based on the print data the second creating unit 12F created and the size of the ink droplets the recording unit 14 can form. The output unit 12H sends the slice data divided at the processing unit 12G.

In the flowchart illustrated in FIG. 9, the print data are created based on the ink thickness. Alternatively, the print data can be created based on the number of ink droplets calculated per pixel.

Also, for example, if the layer thickness can be adjusted by changing to a three-layer structure with small droplets for a site where the density is secured by a single layer structure of large droplets. This embodiment uses a three-layer structure but the present disclosure is not limited thereto. The same applies to a case where the structure has another number of layers.

In addition, although the image processing device has the processing unit in this case, the recording device 30 may have the processing unit.

Embodiment 2

Figure 11:
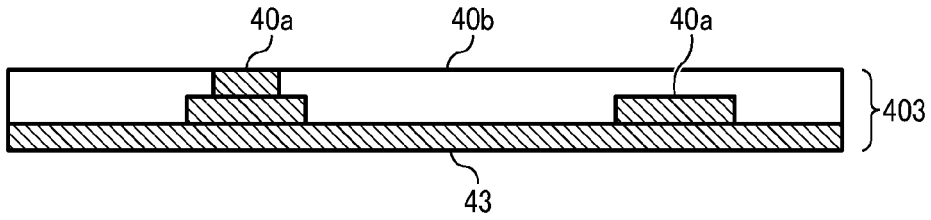
FIG. 11 is a diagram illustrating another embodiment of the present disclosure.

FIG. 11 is a diagram illustrating another embodiment of the present disclosure.

As illustrated in FIG. 11, a dense site 40*a* can be used partially for the thickness adjusting layer adjusting the thickness as described in FIG. 7. Also, a clear ink layer (or transparent color ink layer) 40*b* can be used for the thickness adjusting layer. Accordingly, the ink layer as the ground color is visible through the clear ink layer 40*b*. The ink layer 40*b* can be applied as an underlayer in the case of white ink as illustrated in FIG. 12.

Embodiment 3

Figure 12:
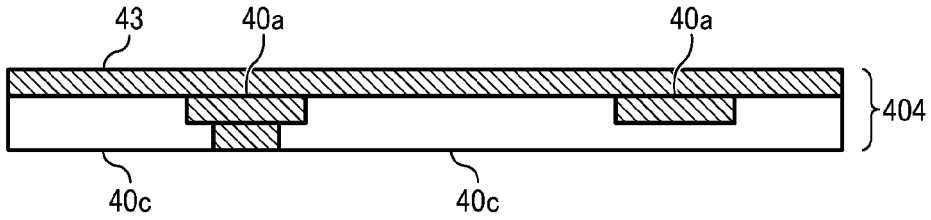
FIG. 12 is a diagram illustrating another embodiment of the present disclosure.

FIG. 12 is a diagram illustrating another embodiment of the present disclosure.

In the embodiment illustrated in FIG. 12, the thickness adjusting layer at sites other than the high dense sites is laminated with white ink. If a UV print layer 404 includes a white ink layer 40*c* for the thickness adjustment, the white ink layer 40*c* is generally not transmissive unlike a clear ink layer so that the white ink layer 40*c* serves as the foundation of the color ink. Therefore, the color of the underlayer (namely, the target part) is interrupted so that the saturation of the color of the ink is efficiently utilized. The saturation means a delicate coloration in media of printing and video pictures.

Embodiment 4

Figure 13A:
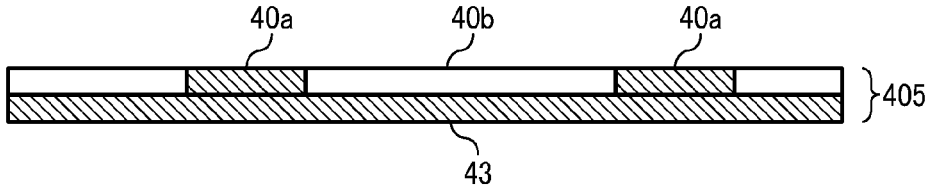
FIGS. 13A and 13B are diagrams illustrating another embodiment of the present disclosure.
Figure 13B:
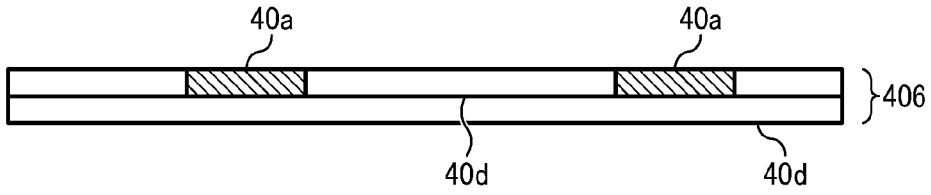

FIGS. 13A and 13B are diagrams illustrating another embodiment of the present disclosure.

For example, at the site where a desired density is secured by a single layer like a UV print layer 405 illustrated in FIG.

13A, the layer thickness of a single layer is adjusted by forming the clear ink layer 40*b* thereon.

However, the clear ink layer 40*b* is formed even in an environment where no clear ink layer 40*b* is required.

To solve this issue, a pale color ink is used to form a layer for the pixel for which the first creating unit 12E created the complementary data. Like a UV print layer 406 illustrated in FIG. 13B, for example, a pale color ink layer 40*d* having the same color of the lamination for thickness adjustment is formed on sites where a single layer of solid cyan is sufficient, namely, two light cyan layers are formed. The pale color ink has low density in comparison with that of typical ink, such as light cyan ink, which is lighter than typical cyan ink. For this reason, in an environment where clear ink or white ink is not necessary but pale color such as light cyan is set, such pale color ink can be used for a thickness adjustment layer instead of clear ink or white ink.

According to the embodiment, ink is preliminarily laminated at sites where the density after drawing is insufficient. Therefore, since the density can be relatively increased in comparison with a single ink layer, a desired density can be obtained even for the site having a large extension ratio. That is, additional droplets are discharged to the highest portion to cancel unevenness, printed matter having high quality can be obtained.

According to the embodiment, if there is a difference in thickness of lamination, the surface after drawing and forming has concavo-convex portions. To prevent this roughness on the surface, the thickness of lamination is made even.

In addition, when clear ink is used for thickness adjustment in an environment where transmission of the color of the under layer (the color of the target part or the color of the ink already printed) is not prevented, rough portions do not appear while the color of the under layer is visible as is. In addition, according to the embodiment, in an environment where pale ink such as light cyan is set, such pale color ink can be used for a thickness adjustment layer instead of clear ink or white ink.

The image forming apparatus of the present disclosure as described above are achieved by executing the processing by a computer. Therefore, as an example, a case in which the present disclosure is executed by the program is described.

For example, as illustrated in the flowchart of FIG. 9, a non-transitory recording medium storing a plurality of instructions which, when executed by one or more processors, cause the processors to perform a control method of an image processing device includes:

a step (Step S1) of an acquiring unit acquiring image data of an image formed by a recording unit employing an inkjet method, a step (Step S2) of a first calculating unit calculating ink thickness per pixel after the ink is discharged based on the image data, a step (Step S3) of a setting unit setting the maximum ink thickness as the target thickness of the image of the ink thicknesses calculated by the first calculating unit, a step (Step S4) of a second calculating unit calculating the difference between the target thickness and the ink thickness per pixel, a step (Step S5) of a first creating unit creating complementary data regulating the thickness corresponding to the difference per pixel, and a step (Step S6) of a second creating unit creating print data including the image data and the complementary data.

Such programs may be stored in a computer-readable recording medium.

The non-transitory recording medium includes, for example, computer-readable recording media such as Compact Disc Read Only Memory (CD-ROM), flexible disks (FD), and CD Recordable (CD-R), semiconductor memories such as flash memories, RAMs, ROMs, and ferroelectric RAM (FeRAM), and hard disk drive (HDD).

According to the present invention, printed matter with high quality can be obtained.

The embodiments described above are just preferred embodiments and the present invention is not limited thereto. Various modifications can be made without departing from the scope of the present invention.

For example, the image forming apparatus 10 illustrated in FIG. 1 can be configured as a single image forming apparatus such as multi-functional peripheral (MFP) and also set as an image forming system including multiple devices. If including multiple devices, the image processing device 12 is configured by an external PC and is connected to the recording device 30 via network such as local area network (LAN).

The embodiments described above are just preferred embodiments and the present invention is not limited thereto. Various modifications can be made without departing from the scope of the present invention.

Modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on.

What is claimed is:

1. An image processing device comprising:

a memory storing a program of instructions; and a processor configured to execute the program of instructions to acquire image data associated with an image to be formed by a recording device configured to employ an inkjet method;

calculate, for each pixel of the image and based on the image data, an associated ink thickness per pixel that indicates a thickness of ink to be discharged to form the pixel of the image, such that a plurality of ink thicknesses associated separate, respective pixels of the image are calculated;

set a maximum ink thickness per pixel, of the plurality of ink thicknesses, as a target thickness associated with the image;

calculate, for each pixel of the image, a difference between the target thickness and the associated ink thickness per pixel;

create, for each pixel of the image, an associated complementary data regulating thickness compensating the difference associated with the pixel and complementary data associated with the associated complementary data regulating thickness; and create print data including the image data and the complementary data, the print data including, for each pixel of the image, the associated ink thickness and the associated complementary data regulating thickness.

2. An image forming apparatus comprising:

the image processing device of claim 1; and a recording device, the recording device configured to discharge the ink based on the print data to form an ink layer.

3. The image forming apparatus according to claim 2, wherein the recording device configured to discharge clear ink to form a layer including the clear ink based on the complementary data.

4. The image forming apparatus according to claim 2, wherein the recording device configured to discharge white ink to forms a layer including the white ink based on the complementary data.

5. The image forming apparatus according to claim 2, wherein the recording device is configured to discharge pale color ink to form a layer including the pale color ink based on the complementary data.

6. A non-transitory recording medium storing a plurality of instructions which, when executed by one or more processors, cause the one or more processors to perform a control method, the method comprising:

acquiring image data associated with an image to be formed by a recording device configured to employ an inkjet method;

calculating, for each pixel of the image and based on the image data, an associated ink thickness per pixel that indicates a thickness of ink to be discharged to form the pixel of the image, such that a plurality of ink thicknesses associated separate, respective pixels of the image are calculated;

setting a maximum ink thickness per pixel, of the plurality of ink thicknesses, as a target thickness associated with the image;

calculating, for each pixel of the image, a difference between the target thickness and the associated ink thickness per pixel;

creating, for each pixel of the image, an associated complementary data regulating thickness compensating the difference per pixel associated with the pixel and complementary data associated with the associated complementary data regulating thickness; and creating print data including the image data and the complementary data, the print data including, for each pixel of the image, the associated ink thickness and the associated complementary data regulating thickness.

7. The non-transitory recording medium of claim 6, wherein the control method that is performed by the one or more processors further includes, causing a recording device to discharge the ink based on the print data to form an ink layer.

8. The non-transitory recording medium of claim 7, wherein the control method that is performed by the one or more processors further includes, causing the recording device to discharge clear ink to form a layer including the clear ink based on the complementary data.

9. The non-transitory recording medium of claim 7, wherein the control method that is performed by the one or more processors further includes, causing the recording device to discharge white ink to form a layer including the white ink based on the complementary data.

10. The image forming apparatus according to claim 7, wherein the control method that is performed by the one or more processors further includes, causing the recording device to discharge pale color ink to form a layer including the pale color ink based on the complementary data.

11. A method of forming an image for decorating an object, the method comprising:

acquiring image data associated with an image to be formed by a recording device configured to employ an inkjet method;

calculating, for each pixel of the image and based on the image data, an associated ink thickness per pixel that indicates a thickness of ink to be discharged to form the pixel of the image, such that a plurality of ink thicknesses associated separate, respective pixels of the image are calculated;

setting a maximum ink thickness per pixel, of the plurality of ink thicknesses, as a target thickness associated with the image;

calculating, for each pixel of the image, a difference between the target thickness and the associated ink thickness per pixel;

creating, for each pixel of the image, an associated complementary data regulating thickness compensating the difference per pixel associated with the pixel and complementary data associated with the associated complementary data regulating thickness; and creating print data including the image data and the complementary data, the print data including, for each pixel of the image, the associated ink thickness and the associated complementary data regulating thickness.

12. The method of claim 11, further comprising:

causing the recording device to discharge the ink based on the print data to form an ink layer.

13. The method of claim 12, further comprising:

causing the recording device to discharge clear ink to form a layer including the clear ink based on the complementary data.

14. The method of claim 12, further comprising:

causing the recording device to discharge white ink to form a layer including the white ink based on the complementary data.

15. The method of claim 12, further comprising:

causing the recording device to discharge pale color ink to form a layer including the pale color ink based on the complementary data.

* * * * *